US008501050B2

(12) United States Patent
Landwehr et al.

(10) Patent No.: US 8,501,050 B2
(45) Date of Patent: Aug. 6, 2013

(54) TITANIUM DIBORIDE-SILICON CARBIDE COMPOSITES USEFUL IN ELECTROLYTIC ALUMINUM PRODUCTION CELLS AND METHODS FOR PRODUCING THE SAME

(75) Inventors: Sean Erin Landwehr, Greensburg, PA (US); Russell Lee Yeckley, Latrobe, PA (US); Roberta R. Yeckley, legal representative, Latrobe, PA (US)

(73) Assignee: Kennametal Inc., Latrobe, PA (US)

( * ) Notice: Subject to any disclaimer, the term of this patent is extended or adjusted under 35 U.S.C. 154(b) by 96 days.

(21) Appl. No.: 13/247,399

(22) Filed: Sep. 28, 2011

(65) Prior Publication Data

US 2013/0075669 A1 Mar. 28, 2013

(51) Int. Cl.
*H01B 1/04* (2006.01)

(52) U.S. Cl.
USPC ..... 252/516; 204/247.3

(58) Field of Classification Search
USPC ..... 252/504, 515, 516; 204/247.3
See application file for complete search history.

(56) References Cited

U.S. PATENT DOCUMENTS

| | | | | |
|---|---|---|---|---|
| 3,808,012 | A * | 4/1974 | Bailey et al. | 501/91 |
| 4,097,567 | A | 6/1978 | Cebulak et al. | |
| 4,224,128 | A | 9/1980 | Walton | |
| 4,297,180 | A | 10/1981 | Foster, Jr. | |
| 4,338,177 | A | 7/1982 | Withers et al. | |
| 4,349,427 | A | 9/1982 | Goodnow et al. | |
| 4,374,761 | A | 2/1983 | Ray | |
| 4,376,690 | A | 3/1983 | Kugler | |
| 4,399,008 | A | 8/1983 | Ray | |
| 4,478,693 | A | 10/1984 | Ray | |
| 4,514,355 | A | 4/1985 | Montgomery | |
| 4,544,469 | A | 10/1985 | Boxall et al. | |
| 4,560,448 | A | 12/1985 | Sane et al. | |
| 4,582,553 | A | 4/1986 | Buchta | |
| 4,664,760 | A | 5/1987 | Jarrett | |
| 4,929,328 | A * | 5/1990 | Besmann et al. | 204/279 |
| 4,983,340 | A | 1/1991 | Montgomery | |
| 5,028,301 | A | 7/1991 | Townsend | |
| 5,100,845 | A | 3/1992 | Montgomery | |
| 5,158,655 | A | 10/1992 | Townsend | |
| 5,217,583 | A | 6/1993 | Sekhar et al. | |
| 5,227,045 | A | 7/1993 | Townsend | |
| 5,310,476 | A | 5/1994 | Sekhar et al. | |
| 5,340,448 | A | 8/1994 | Sekhar et al. | |
| 5,364,442 | A | 11/1994 | Sekhar | |
| 5,378,325 | A | 1/1995 | Dastolfo, Jr. et al. | |
| 5,378,327 | A | 1/1995 | Sekhar et al. | |
| 5,538,604 | A | 7/1996 | Keller et al. | |

(Continued)

OTHER PUBLICATIONS

Li et al "Research Progress in TiB2 Wettable Cathode for Al Reduction", TMS/JOM (Aug. 2008) pp. 32-37.*

(Continued)

*Primary Examiner* — Mark Kopec
(74) *Attorney, Agent, or Firm* — Matthew W. Gordon, Esq.

(57) ABSTRACT

Composite materials comprising titanium diboride, silicon carbide and carbon-containing scavenger additions are useful in electrolytic aluminum production cells. The carbon-containing scavenger additions may include tungsten carbide, boron carbide and/or carbon. The amounts of titanium diboride, silicon carbide and carbon-containing scavenger are controlled in order to provide optimum performance. The titanium diboride/silicon carbide composite materials may be used as cathodes in electrolytic aluminum production cells and are electrically conductive, exhibit desirable aluminum wetting behavior, and are capable of withstanding exposure to molten cryolite, molten aluminum and oxygen at elevated temperatures during operation of such cells.

18 Claims, 3 Drawing Sheets

U.S. PATENT DOCUMENTS

| | | | | |
|---|---|---|---|---|
| 5,683,663 | A | 11/1997 | Keller et al. | |
| 5,961,811 | A | 10/1999 | Keller | |
| 6,146,559 | A * | 11/2000 | Zank | 264/29.6 |
| 6,371,746 | B1 * | 4/2002 | Shiomi et al. | 425/78 |
| 6,402,926 | B1 | 6/2002 | Sekhar et al. | |
| 6,403,210 | B1 * | 6/2002 | Stuivinga et al. | 428/307.7 |
| 6,419,812 | B1 | 7/2002 | Beck et al. | |
| 6,419,813 | B1 | 7/2002 | Brown et al. | |
| 6,616,829 | B2 | 9/2003 | Keller et al. | |
| 6,783,656 | B2 | 8/2004 | De Nora et al. | |
| 7,462,271 | B2 | 12/2008 | Dionne et al. | |
| 7,723,247 | B2 | 5/2010 | Zhang et al. | |
| 2007/0270302 | A1 | 11/2007 | Zhang et al. | |
| 2008/0227619 | A1 | 9/2008 | Zhang et al. | |
| 2009/0048087 | A1 | 2/2009 | Zhang et al. | |
| 2010/0126877 | A1 * | 5/2010 | Luo et al. | 205/686 |
| 2011/0114479 | A1 | 5/2011 | Yeckley et al. | |

OTHER PUBLICATIONS

Finch et al., "Crack Formation and Swelling of TiB2-Ni Ceramics in Liquid Aluminum", Communications of the American Ceramic Society, Jul. 1982, pp. C-100 and C-101.

Kang et al., "Effect of Iron and Boron Carbide on the Densification and Mechanical Properties of Titanium Diboride Ceramics", J. Am. Ceram. Soc., 1989, pp. 1868-1872, vol. 72, No. 10.

Einarsrud et al., "Pressureless Sintering of Titanium Diboride with Nickel, Nickel Boride, and Iron Additives", J. Am. Ceram. Soc., 1997, pp. 3013-3020, vol. 80, No. 12.

Zhang et al., "Microstructure and Mechanical Properties of TiB2/(Ni+Mo) Composites Fabricated by Hot Pressing", J. Mater. Sci. Technol., 2000, pp. 634-636, vol. 16, No. 6.

Chamberlain et al., "High-Strength Zirconium Diboride-Based Ceramics", J. Am. Ceram. Soc., 2004, pp. 1170-1172, vol. 87, No. 6.

Chamberlain et al., "Pressureless Sintering of Zirconium Diboride", J. Am. Ceram. Soc., 2006, pp. 450-456, vol. 89, No. 2.

Zhang et al., "Pressureless Densification of Zirconium Diboride with Boron Carbide Additions", J. Am. Ceram. Soc., 2006, pp. 1544-1550, vol. 89, No. 5.

Zhang et al., "Pressureless Sintering of ZrB2-SiC Ceramics", J. Am. Ceram. Soc., 2008, pp. 26-32, vol. 91, No. 1.

* cited by examiner

TITANIUM DIBORIDE-SILICON CARBIDE COMPOSITES USEFUL IN ELECTROLYTIC ALUMINUM PRODUCTION CELLS AND METHODS FOR PRODUCING THE SAME

FIELD OF THE INVENTION

The present invention relates to composite materials for use in electrolytic aluminum production cells, and more particularly relates to composites comprising titanium diboride, silicon carbide and carbon-containing scavenger additives useful as cathodes in aluminum production cells.

BACKGROUND INFORMATION

Materials used in electrolytic aluminum production cells, also known as Hall-Héroult cells, must be thermally stable at high temperatures on the order of 1,000° C., and must be capable of withstanding extremely harsh conditions such as exposure to molten cryolite, molten aluminum, and oxygen at elevated temperatures. Although various types of materials have been used as cathodes and to line the walls of electrolytic aluminum production cells, a need still exists for improved materials capable of withstanding such harsh conditions.

Titanium diboride ($TiB_2$) would be desirable for use as a cathode material in electrolytic aluminum production cells. When titanium diboride is used as a wettable cathode, the energy used for operation of the cell can be greatly reduced. Titanium diboride has many desirable properties including wettability by molten aluminum, high temperature stability and exceptional corrosion resistance. However, the manufacture of the titanium diboride cathodes is difficult because titanium diboride powders are not easily sintered and do not readily form dense parts. Titanium diboride powders often require the application of very high pressures and temperatures well in excess of 2,000° C. in order to decrease porosity of the sintered material. Even at such extreme conditions, titanium diboride components are often not fully dense or they exhibit microcracking, both of which decrease performance.

Sintering aids have been added to titanium diboride in attempts to decrease processing temperatures, microcracking and residual porosity. However, conventional sintering aids have been found to decrease the corrosion resistance of titanium diboride components, particularly in harsh environments such as found in electrolytic aluminum production cells.

SUMMARY OF THE INVENTION

The present invention provides composite materials comprising titanium diboride, silicon carbide (SiC) and minor amounts of carbon-containing scavenger additions such as tungsten carbide (WC), boron carbide ($B_4C$) and/or carbon. The $TiB_2$/SiC composite materials may be used as cathodes in electrolytic aluminum production cells. The amounts of titanium diboride, silicon carbide, and carbon-containing scavenger(s) are controlled in order to provide optimum performance. The $TiB_2$/SiC composite materials are electrically conductive, exhibit desirable aluminum wetting behavior, and are capable of withstanding exposure to molten cryolite, molten aluminum and oxygen at elevated temperatures during operation of electrolytic aluminum production cells.

An aspect of the present invention is to provide a composite cathode for use in an electrolytic aluminum production cell, the composite cathode comprising from about 70 to about 98 weight percent titanium diboride, from about 2 to about 30 weight percent silicon carbide, and at least about 0.2 weight percent of at least one carbon-containing scavenger.

Another aspect of the present invention is to provide a method of making a composite cathode for use in an electrolytic aluminum production cell. The method comprises mixing powders of titanium diboride, silicon carbide and at least one carbon-containing scavenger, and consolidating the mixture to form the composite cathode.

These and other aspects of the present invention will be more apparent from the following description.

DETAILED DESCRIPTION

Figure 1:
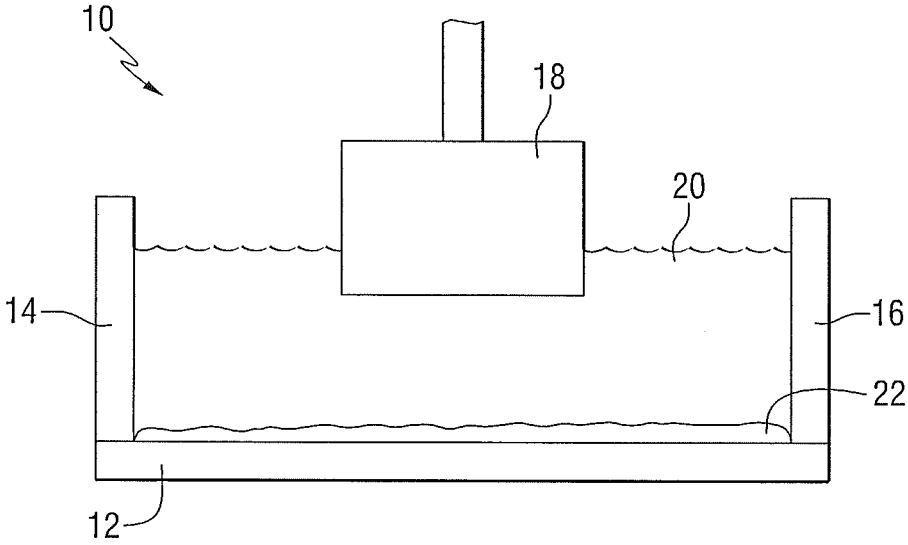
FIG. 1 is a partially schematic side sectional view of an electrolytic aluminum production cell including a cathode that may be made of a $TiB_2$/SiC composite material in accordance with an embodiment of the present invention.

The present invention provides composite materials comprising titanium diboride, silicon carbide and carbon-containing scavenger additives that are particularly suited as cathode materials in electrolytic aluminum production cells. FIG. 1 schematically illustrates an electrolytic aluminum production cell 10 including a bottom wall or cathode 12 and side walls 14, 16. An anode 18 extends into the cell 10. The anode 18 may be a carbonaceous consumable anode, or may be a stable inert anode. During the electrolytic aluminum production process, the cell 10 contains molten cryolite 20 comprising alumina in a fluoride salt bath, and current is generated between the anode 18 and the cathode bottom wall 12 of the cell. During the electrolytic reduction process, the alumina in the molten cryolite 20 is converted to molten aluminum 22, which settles on the cathode 12 of the cell. The cell 10 is typically open to the atmosphere, and at least the upper portions of the side walls 14 and 16 are exposed to oxygen in the surrounding air.

Each of the cathode 12 and side walls 14 and 16 must be thermally stable at the elevated temperatures experienced during the electrolytic process, and must be capable of withstanding exposure to molten cryolite, molten aluminum, and oxygen at such elevated temperatures. In addition, the cathode 12, and side walls 14 and 16, should have satisfactory aluminum wetting characteristics and controlled levels of electrical conductivity. The cathode 12, and side walls 14 and 16, of the cell 10 may be fabricated in the form of plates that are installed in the interior side walls of the cell. The plates may have any suitable thickness.

In accordance with an embodiment of the present invention, the cathode 12 of the cell 10 may be made of a composite material comprising titanium diboride, silicon carbide and at least one carbon-containing scavenger additive such as tungsten carbide, boron carbide and/or carbon. The titanium diboride phase of the composite material typically forms a continuous interconnected skeleton in the material, while the silicon carbide phase may be either continuous or discontinuous, depending upon the relative amount that is present in the material.

The composite materials of the present invention typically comprise from about 70 to about 98 weight percent titanium diboride, for example, from about 85 to about 98 weight percent. In a particular embodiment, the titanium diboride comprises from about 90 to about 96 weight percent of the composite material. When used as a cathode material, the $TiB_2$-based composite possesses desirable electrical conductivity and aluminum wetting behavior, and is corrosion resistant, i.e., is capable of withstanding exposure to molten cryolite, molten aluminum and oxygen at elevated temperatures during operation of electrolytic aluminum production cells.

In accordance with an embodiment of the present invention, silicon carbide is present in the composite material in typical amounts of from about 2 to about 30 weight percent, for example, from about 3 to about 10 weight percent. In a particular embodiment, the silicon carbide is present in an amount of from about 4 to about 8 weight percent. The use of silicon carbide as an additive aids in sintering and provides good corrosion resistance to both molten salts and molten aluminum.

In accordance with the present invention, at least one carbon-containing scavenger is present in the $TiB_2$/SiC composite material. The scavenger additives provide a source of carbon that preferentially reacts with oxygen to reduce or eliminate the presence of unwanted oxide species such as titanium dioxide and boron oxide. Suitable carbon-containing scavenger materials include metal carbides such as tungsten carbide, boron carbide and the like. Furthermore, carbon in various forms such as phenolic resin, carbon black and/or graphite may be used. The carbon-containing scavenger addition(s) are typically present in relatively small amounts of from about 0.2 to about 10 weight percent, for example, from about 1 to about 8 weight percent.

In certain embodiments of the present invention, tungsten carbide is used as the carbon-containing scavenger. The WC may be added to the $TiB_2$/SiC composite materials in typical amounts of from about 0.25 to about 6 weight percent, for example, from about 1 to about 5 weight percent. In a particular embodiment, the tungsten carbide may be provided in an amount of from about 2 to about 3 weight percent. The tungsten carbide acts as an oxygen scavenger, aids in sintering, and forms a solid solution with the $TiB_2$. The WC may be bound in the structure and may improve corrosion resistance to molten salts and molten aluminum. The WC may be added as a discrete powder before or during powder mixing, or may be introduced during the mixing operation as a result of erosion of WC-containing mixing aids, e.g., through the use of WC milling media and/or milling linings.

In accordance with another embodiment of the present invention, boron carbide is used as the scavenger material in typical amounts of from about 0.5 to about 10 weight percent, for example, from about 1 to about 8 weight percent. In a particular embodiment, the boron carbide comprises from about 2 to about 5 weight percent. The $B_4C$ may be added to create the following reaction which reduces or eliminates surface oxides on the $TiB_2$ particles:

$$2TiO_2+B_4C+3C \rightarrow 2TiB_2+4CO.$$

The use of boron carbide may provide transient phases that reduce oxide species that would otherwise be detrimental to sintering and performance of the composite material.

In a further embodiment of the present invention, carbon is used as the scavenger material. In this embodiment, the total amount of carbon typically ranges from about 0.2 to about 10 weight percent, for example, from about 0.3 to about 8 weight percent. In a particular embodiment, the total amount of carbon added is from about 0.5 to about 4 weight percent. The carbon source may be provided in the form of amorphous phenolic resin, carbon black, graphite or the like. Such carbon sources may reduce oxide species that would otherwise be detrimental to sintering and performance of the composite material.

Other materials may optionally be added to the present $TiB_2$/SiC composite materials, for example, molybdenum, chromium, iron, cobalt, nickel, niobium, tantalum and/or the carbides or borides of such metals. Such optional additives may be added to the composite materials in a total amount of up to about 10 weight percent, for example, a total amount of up to about 2 weight percent. These materials may increase the ability to densify the $TiB_2$/SiC composite materials.

In accordance with an embodiment of the present invention, the $TiB_2$/SiC composite materials may be substantially free of additional materials, i.e., such additional materials are not purposefully added to the composite materials and are only present in trace amounts or as impurities.

The present composite materials may be made by consolidating powder mixtures of the titanium diboride, silicon carbide and carbon-containing scavenger additives. In one embodiment, consolidation may be achieved by hot pressing the powders. In another embodiment, consolidation may be achieved by pressing the powders at ambient temperature, e.g., cold isostatic pressing, followed by vacuum sintering.

The titanium diboride powder typically has an average particle size range of from about 1 to about 50 microns, for example, from about 2 to about 10 microns. The silicon carbide powder typically has an average particle size range of from about 0.5 to about 20 microns, for example, from about 2 to about 10 microns. When tungsten carbide is used as a carbon-containing additive, it may have a typical average particle size range of from about 0.5 to about 15 microns, for example, from about 1 to about 3 microns. In an embodiment of the invention where the carbon-containing additive comprises boron carbide, the $B_4C$ powder may typically have an average particle size range of from about 0.5 to about 15 microns, for example, from about 1 to about 3 microns. By providing relatively small particle sizes, the WC and/or $B_4C$ tend to react with the surface oxides more readily.

The powders may be mixed in the desired ratio by any suitable mixing method such as dry blending or ball milling. The resultant powder mixture is consolidated by any suitable process, for example, hot pressing at pressures typically ranging from about 10 to about 40 MPa, and at temperatures typically ranging from about 1,800 to about 2,200° C. The resultant hot pressed powders have high densities, typically above 95 percent, for example, above 98 or 99 percent.

The consolidation step may include sintering of the powder mixture at elevated pressures, e.g., by hot pressing, sintering at ambient pressures, or sintering under vacuum. In one embodiment, the powder mixture may be sintered by spark plasma sintering or field assisted sintering techniques in which heating is achieved by passing electric current through hot press dies and the workpiece. Use of this method may reduce the processing temperature to a range of from about 1,600 to about 2,000° C.

An embodiment of the invention provides for hot pressing of a body of the composite material to greater than 90 percent of theoretical density at 1,800° C. with 30 MPa of pressure, and about 100 percent of theoretical density at 1,900° C. with 30 MPa of pressure. To accomplish this, $TiB_2$ powder is combined with from 2 to 30 volume percent (1.5 to 24 weight percent) SiC powder, typically from 2 to 10 volume percent (4 to 8 weight percent) and milled with WC media. The milling process adds controlled amounts of WC, which aids in sintering. The addition of WC from processing is generally from 1 to 10 weight percent, typically from 2 to 3 weight percent.

Another embodiment of the invention provides for the densification of a body of the composite material to greater than 90 percent of theoretical density at 2,000° C., and greater than 95 percent of theoretical density at 2,100° C. under ambient pressure or vacuum. To accomplish this the same treatment is employed as described in the embodiment above, but using from 2 to 10 weight percent boron carbide, typically from 5 to 7 weight percent. In conjunction with $B_4C$, carbon additions in the form of phenolic resin, amorphous carbon black, graphite or the like may be used in amounts of from 1 to 5 weight percent, typically from 2 to 3 weight percent.

The following examples are intended to illustrate various aspects of the invention, and are not intended to limit the scope of the invention.

Composite plates were made from $TiB_2$, SiC and $B_4C$ powders having the specifications set forth in Tables 1, 2 and 3 below.

TABLE 1

$TiB_2$ Specifications

| | Min | Max |
|---|---|---|
| Boron content (weight %) | 30.0 | 31.0 |
| Carbon content (weight %) | — | 0.09 |
| Calcium content (weight %) | — | 0.5 |
| Nitrogen content (weight %) | 0.1 | 0.8 |
| Oxygen content (weight %) | 0.6 | 1.5 |
| Particle size $d_{10}$ (μm) | 1.5 | 2.5 |
| Particle size $d_{50}$ (μm) | 5.5 | 6.0 |
| Particle size $d_{90}$ (μm) | — | 13 |

TABLE 2

SiC Specifications

| | Typical |
|---|---|
| SiC (weight %) | 99.5 |
| Free carbon content (weight %) | 0.1 |
| Total $SiO_2$ content (weight %) | 0.2 |
| Free silicon content (weight %) | 0.03 |
| Total iron content (weight %) | 0.04 |
| Average particle size (μm) | 2.5 |

TABLE 3

$B_4C$ Specifications

| | Typical |
|---|---|
| Total boron content (weight %) | 77.5 |
| Total carbon content (weight %) | 21.5 |
| Total iron content (weight %) | 0.2 |
| Total oxygen content (weight %) | 0.6 |
| Average particle size (μm) | 1.5 |

Example 1

Starting powders of $TiB_2$ and SiC having specifications as set forth in Tables 1 and 2 and at selected weight ratios were milled for 4 to 16 hours with a ball milling process using WC milling media. The ratios employed were: 96 weight percent $TiB_2$-4 weight percent SiC; and 92 weight percent $TiB_2$-8 weight percent SiC. The blended powders were loaded into a graphite die for hot pressing. The hot pressing schedule was as follows, with the maximum temperature being 1,900° C.: pull vacuum to <100 mtorr; heat at 25° C./min to 1,650° C. while under vacuum; hold for 1 hour under vacuum; after hold backfill with Ar, apply 10 MPa of pressure and heat at 10° C./min to maximum temperature; once maximum temperature is reached gradually increase pressure over 10 min to 30 MPa; after maximum pressure is reached maintain maximum pressure of 30 MPa until ram travel stops, which is typically 60 to 90 min at maximum temperature and pressure; once ram travel stops remove pressure and allow the furnace to cool to room temperature.

After the materials were hot pressed, their densities were measured. Vickers hardness was measured on polished cross-sections of the materials and Young's modulus was determined with a time-of-flight calculation using an ultrasonic transducer. The properties of the different compositions are shown in Table 4.

TABLE 4

Properties of $TiB_2$/SiC Composites with WC Additions

| Composition (weight percent) | Density (g/cm$^3$)/ % Theoretical** | Young's Modulus (GPa) | Vickers Hardness (GPa) |
|---|---|---|---|
| 96$TiB_2$ 4SiC * | 4.33/97.5 | 530 | 20.1 |
| 92$TiB_2$ 8SiC * | 4.37/104.8 | 550 | 22.2 |

* Composition contains 2-3 weight percent WC from the milling process.

**Theoretical density is based on rule of mixtures calculation and does not account for increase in density because of solid solution or secondary phase formation.

Figure 2:
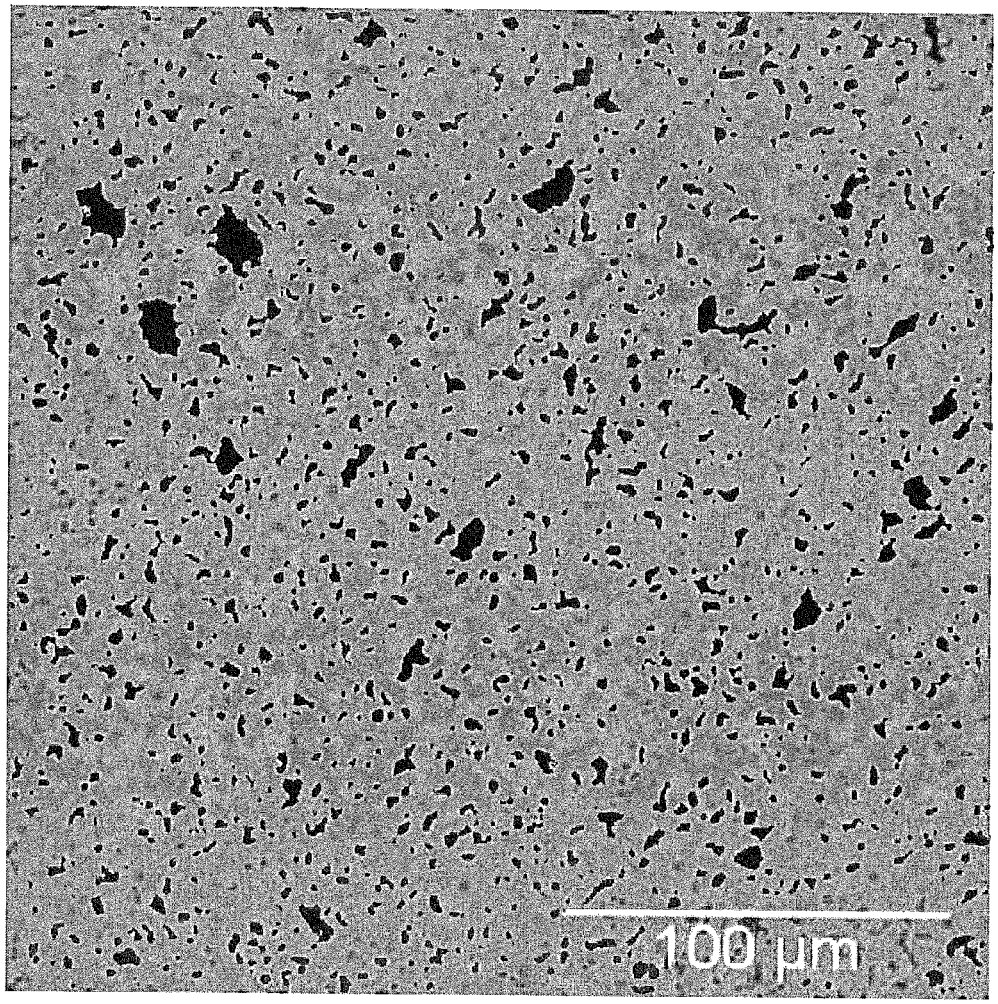
FIG. 2 is a micrograph of a $TiB_2$/SiC composite material with small additions of WC in accordance with an embodiment of the present invention.

A sample of the $TiB_2$/SiC/WC composite is shown in the micrograph of FIG. 2. The darkest regions are SiC, the medium gray regions are $TiB_2$ grain cores, and the lightest regions are W-rich shell regions of the $TiB_2$ grains.

Example 2

Starting powders of $TiB_2$, SiC and $B_4C$ having specifications as set forth in Tables 1, 2 and 3, and phenolic resin were milled for 4 to 16 hours with a ball milling process using WC milling media. The ratios employed were: 92 weight percent $TiB_2$-4 weight percent SiC-2 weight percent $B_4C$-2 weight percent phenolic resin; 88 weight percent $TiB_2$-8 weight percent SiC-2 weight percent $B_4C$-2 weight percent phenolic resin; 82 weight percent $TiB_2$-15 weight percent SiC-2 weight percent $B_4C$-1 weight percent phenolic resin; and 75 weight percent $TiB_2$-22 weight percent SiC-2 weight percent $B_4C$-1 weight percent phenolic resin. The blended powders were pressed in a steel die at ~65 MPa and then cold isostatically pressed at ~200 MPa. The sintering schedule was as follows, with the maximum temperature being 1,900-2,100° C.: pull vacuum to <100 mtorr; heat at 10° C./min to 1,650° C. while under vacuum; hold for 1 hour under vacuum at 1,650° C.; after hold backfill with Ar and heat at 15° C./min to maximum temperature; once maximum temperature is reached hold for 3 hours; after final hold allow to cool to room temperature.

After the materials were sintered, their densities were measured. Vickers hardness was measured on polished cross-sections of the material and Young's modulus was determined with a time-of-flight calculation using an ultrasonic transducer. The properties of the different compositions are shown in Table 5.

TABLE 5

Properties of $TiB_2$/SiC Composites with $B_4C$, WC and Carbon Additions

| Composition | Density (g/cm$^3$)/ % Theoretical** | Young's Modulus (GPa) | Vickers Hardness (GPa) |
|---|---|---|---|
| 96% $TiB_2$-4% SiC-2% $B_4C$-2% Phenolic Resin* | 4.00/90.1 | — | — |
| 92% $TiB_2$-8% SiC-2% $B_4C$-2% Phenolic Resin* | 4.01/91.6 | — | |
| 82% $TiB_2$-15% SiC-2% $B_4C$-1% Phenolic Resin* | 4.37/102.6 | 500 | 19.9 |
| 75% $TiB_2$-22% SiC-2% $B_4C$-1% Phenolic Resin* | 4.29/103.6 | 490 | 20.6 |

*Composition contains 2-3 wt % WC from the milling process.

**Theoretical density is based on rule of mixtures calculation and does not account for increase in density because of solid solution or secondary phase formation.

Figure 3:
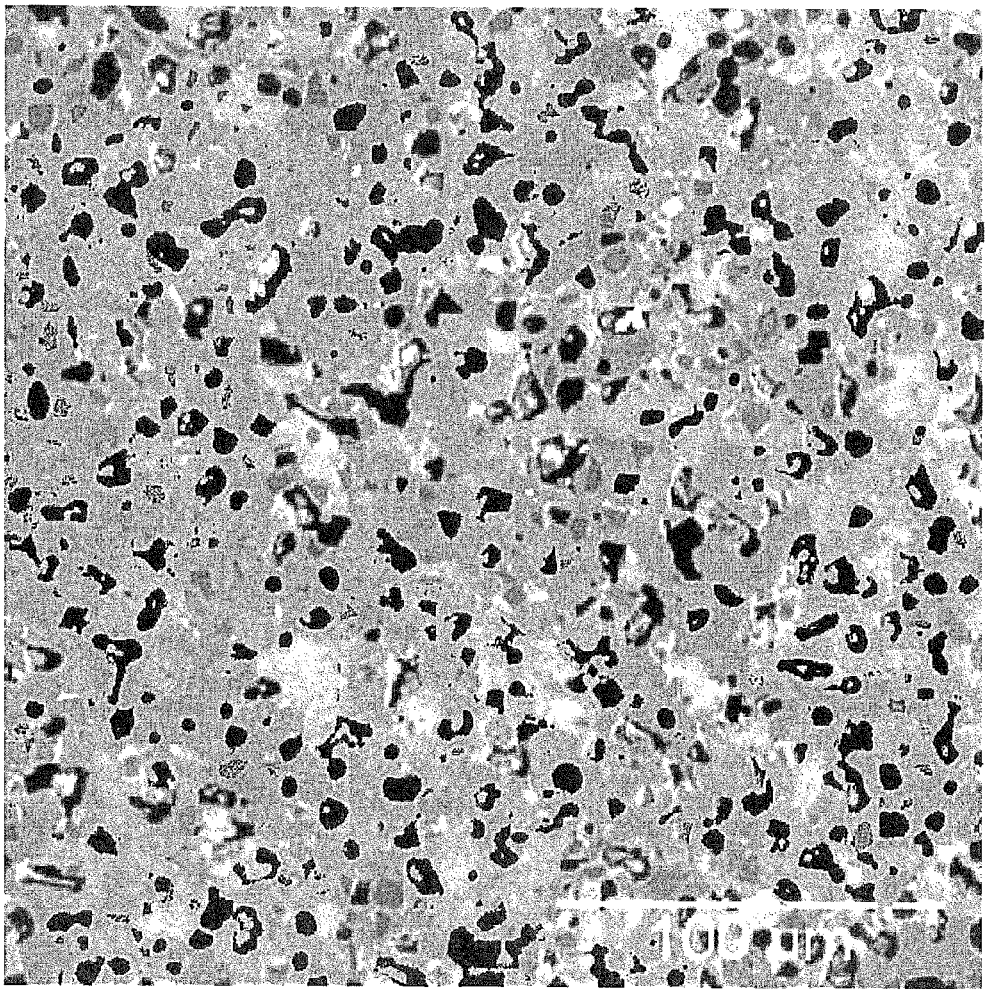
FIG. 3 is a micrograph of a $TiB_2$/SiC composite material with small additions of WC and $B_4C$ in accordance with another embodiment of the present invention.

A sample of the $TiB_2$—SiC composite with $B_4C$ additions is shown in the micrographs of FIG. 3. The dark regions are SiC, or in some cases residual $B_4C$. The medium gray regions are $TiB_2$ grain cores, and the lightest regions are W-rich shell regions of the $TiB_2$ grains.

Whereas particular embodiments of this invention have been described above for purposes of illustration, it will be evident to those skilled in the art that numerous variations of the details of the present invention may be made without departing from the invention as defined in the appended claims.

The invention claimed is:

1. A composite cathode for use in an electrolytic aluminum production cell, the composite cathode comprising from about 85 to about 98 weight percent titanium diboride, from about 2 to about 30 weight percent silicon carbide, and at least about 0.2 weight percent of at least one carbon-containing scavenger additive.

2. The composite cathode of claim 1, wherein the silicon carbide comprises from about 3 to about 10 weight percent of the composite cathode.

3. The composite cathode of claim 1, wherein the carbon-containing scavenger additive comprises tungsten carbide, boron carbide and/or carbon.

4. The composite cathode of claim 1, wherein the carbon-containing scavenger additive comprises tungsten carbide in an amount of from about 1 to about 10 weight percent of the composite cathode.

5. The composite cathode of claim 4, wherein the tungsten carbide comprises from about 2 to about 5 weight percent.

6. The composite cathode of claim 1, wherein the carbon-containing scavenger additive comprises boron carbide in an amount of from about 2 to about 10 weight percent of the composite cathode.

7. The composite cathode of claim 6, wherein the boron carbide comprises from about 1 to about 5 weight percent.

8. The composite cathode of claim 6, wherein the carbon-containing scavenger additive further comprises tungsten carbide.

9. The composite cathode of claim 8, wherein the carbon-containing scavenger additive further comprises carbon from phenolic resin.

10. The composite cathode of claim 1, wherein the carbon-containing scavenger additive comprises carbon from phenolic resin, carbon black or graphite.

11. The composite cathode of claim 10, wherein the carbon comprises from about 0.2 to about 10 weight percent of the composite cathode.

12. The composite cathode of claim 11, wherein the carbon is from phenolic resin and comprises from about 0.5 to about 4 weight percent.

13. The composite cathode of claim 1, wherein the titanium diboride has an average particle size of from about 1 to about 50 microns, and the silicon carbide has an average particle size of from about 1 to about 50 microns.

14. The composite cathode of claim 13, wherein the carbon-containing scavenger additive has a smaller average particle size than the average particle sizes of the titanium diboride and the silicon carbide.

15. A composite cathode for use in an electrolytic aluminum production cell, the composite cathode comprising from about 70 to about 98 weight percent titanium diboride, from about 2 to about 30 weight percent silicon carbide, and at least about 0.2 weight percent of a scavenger additive comprising tungsten carbide.

16. A method of making a composite cathode for an electrolytic aluminum production cell comprising:

mixing powders of titanium diboride, silicon carbide and at least one carbon-containing scavenger additive, wherein powders of titanium diboride comprise 85 to 98 weight percent of the total powder mixture; and consolidating the mixture to form the composite cathode.

17. The method of claim 16, wherein the mixture is consolidated by hot pressing.

18. The method of claim 16, wherein the mixture is consolidated by cold pressing followed by sintering at or below atmospheric pressure.

* * * * *